United States Patent [19]

Madsen

[11] Patent Number: 5,052,797

[45] Date of Patent: Oct. 1, 1991

[54] COPY VIEWER

[76] Inventor: Erik H. Madsen, 2405 Camino Way, Salt Lake City, Utah 84121

[21] Appl. No.: 481,617

[22] Filed: Feb. 20, 1990

[51] Int. Cl.[5] ..... B41J 13/00

[52] U.S. Cl. ..... 353/28; 353/22; 353/98; 353/30; 353/DIG. 5; 40/341; 40/348; 356/392; 356/291

[58] Field of Search ..... 353/98, 99, 28, 30, 353/DIG. 5, 22, 23; 356/393, 392, 391; 340/716; 40/341, 348, 349; 358/185, 93

[56] References Cited

U.S. PATENT DOCUMENTS

| | | | |
|---|---|---|---|
| 1,840,920 | 1/1932 | Spaulding | 353/98 |
| 2,155,248 | 4/1939 | Adams | 356/393 |
| 2,861,357 | 11/1958 | Knutsen | 353/30 |
| 3,297,822 | 1/1967 | Braid | 356/393 |
| 3,460,894 | 8/1969 | Khalil | 356/393 |
| 3,631,396 | 12/1971 | Spertus | 353/28 |
| 3,837,740 | 9/1974 | Johnson | 353/98 |
| 4,408,850 | 10/1983 | Norek | 353/98 |

FOREIGN PATENT DOCUMENTS

| | | | |
|---|---|---|---|
| 1518275 | 7/1978 | United Kingdom | 353/DIG. 5 |

*Primary Examiner*—William A. Cuchlinski, Jr.
*Assistant Examiner*—William C. Dowling
*Attorney, Agent, or Firm*—M. Reid Russell

[57] ABSTRACT

A copy viewer having a support stand for holding material to be copied in a viewing position and a "see-through" display device for displaying copied material directly over the material to be copied.

11 Claims, 2 Drawing Sheets

COPY VIEWER

BACKGROUND OF THE INVENTION

1. Field of the Invention

The present invention relates to devices for holding material to be copied, edited, or otherwise processed and to the displaying of copied materials.

2. Prior Art

It has long been recognized that a typist can work most efficiently if material being copies is positioned for easy viewing during the typing operation. It has also been recognized that if the material being copied can be compared with output product by the typist, such changes as may be necessary in the output product can be readily achieved.

Various types of paper holders and racks have been proposed in the past to hold a typist's copy material at a convenient viewing location.

U.S. Pat. No. 3,990,565, discloses a typewriter designed with a keyboard arranged to split into two sections, each of which pivots to a side and upright, so that material to be copied can be positioned in the normal keyboard area directly in front of the typist and on line with a magnified viewing area showing the material typed. The arrangement is intended to permit the typist to more quickly and accurately determine if the material being copied has been properly copied. The prior art devices with which I am familiar still require that the typist at least move his or her eyes from a material to be copies in one area to another area to view the material that has been typed in making a comparison to determine whether or not errors have been made.

OBJECTS OF THE INVENTION

Principal objects of the present invention are to provide a system for positioning material to be copied, corrected or edited and the typed material produced from such material to be copied, corrected or edited such that the typist does not have to physically move their head, or even eyes, in order to make a comparison of the typed material against the material to be typed to detect errors.

Still other objects of the invention are to devise a system for positioning copies material and material being copied in such a way that a viewer can look through one to compare it against the other.

Still another object of the invention is to provide such a system for positioning copied material for comparison with material being copied, that is adaptable for use with different types of equipment, such as typewriters and word processors.

FEATURES OF THE INVENTION

Principal features of the a preferred embodiment of the invention include a support stand, a holder for material to be copies, a projector that is positioned to direct images toward the holder for material to be copied, and a semi-reflective semi-transparent sheet overlying the material to be copied when said material is in the holder.

In another preferred embodiment of the invention, the holder for the material to be copied, which may be a paper holder, or a CRT display device, is supported by a stand, and the copied material is displayed on a transparent liquid crystal display positioned to overlie the material to be copied and the holder therefore.

In still another embodiment of the invention the holder for material to be copied may be a CRT display device with a screen on which material to be copied is displayed through the CRT display device tube to be viewed and the copied material may also be projected to the screen for viewing. Alternatively, the material to be copied may be projected onto the screen of the CRT display and the Copied material may be viewed as presented through the CRT display device tube. In either case the material to be copied and the material copied are displayed with one overlying the other for simultaneous viewing. Further, the material to be copied can be differentiated from the copied material by having the letters and/or numbers in the text appear in different sizes, type style, colors of type, or at different focal depths.

Other objects and features of the invention will become apparent from the following detailed description and drawings, disclosing what is presently contemplated as being the best modes of the invention.

THE DRAWINGS

DETAILED DESCRIPTION OF THE INVENTION

Figure 1:
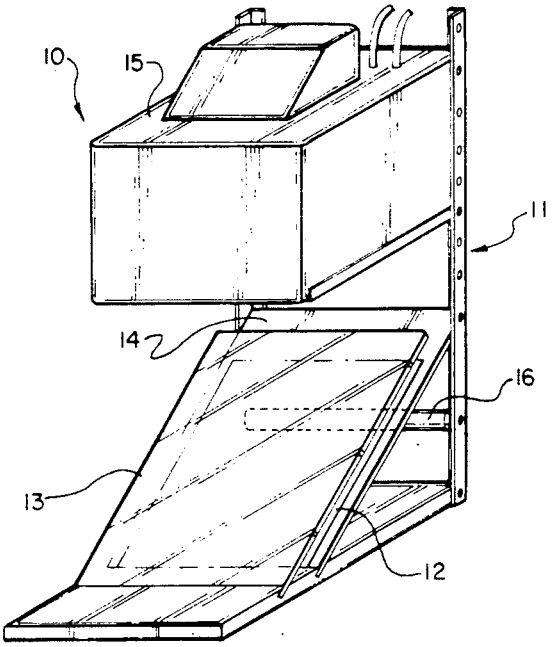
FIG. 1 is a perspective view of a preferred embodiment of the system of the invention.

Referring now to the drawings:

In the illustrated preferred embodiment of FIG. 1, the copy viewer of the invention, shown generally at 10, comprises a stand 11, a holder 12 for material to be copied, a semi-reflective semi-transparent sheet 13 carried by the support stand 11 and spaced from and overlying a backrest 14 for material 12 to be copied. A projector 15, that is preferably a cathode ray tube, is fixed to and carried by an upright portion of the stand 11 and is positioned to overlie and reflect images onto the surface of sheet 13. It will be apparent, that while the projector 15 is shown immovably mounted to the upright portion of stand 11, the projector can be made movably vertically with respect to the support stand to permit better focusing on the surface of sheet 13.

Preferably, a light source, such as fluorescent tube 16, that extends across and is supported by the upright portion of stand 11 is arranged to provide backlighting through the holder 12 to better illuminate the material to be copied that is placed thereon. To permit proper backlighting of the material to be copied, the backrest 14 is preferably made from a sheet of translucent material, such as plastic, that will permit light from behind to better illuminate the material to be copied, while not interfering with display of the copied material that is projected onto sheet 13 from the cathode ray tube projector 15. Images of copied material are supplied to the cathode ray tube projector from a computer, or other input device (not shown) in conventional fashion.

It will be apparent that the user copies from material 12, the copied material will be as it is displayed on the semi-reflective semi-transparent sheet overlying the material to be copied. The user looks the copied material and at the same time looks through the material to see and compare the material being copied with the copied material. The comparison is made without the user having to look back and forth from area to area and with maxim accuracy.

Figure 2:
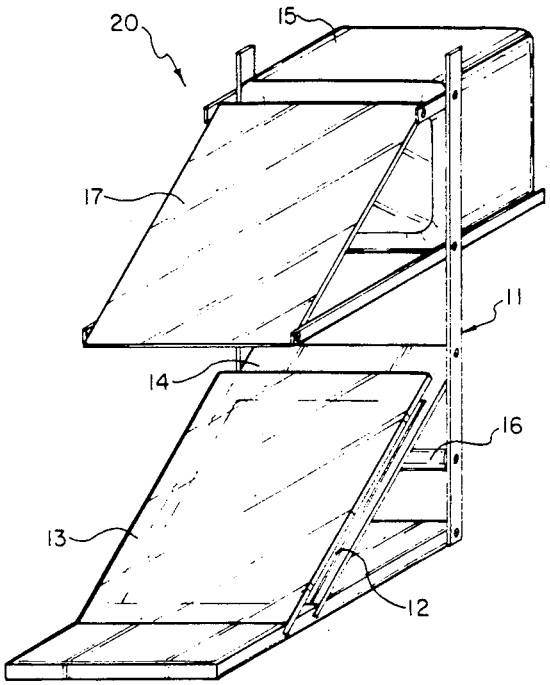
FIG. 2, is a similar view showing another embodiment of the invention.

In the embodiment of the shown in FIG. 2, the copy viewer 20 is the same as the 10 previously described except that the cathode ray 15 projects to a mirror 17 and the image is then reflected onto the semi-transparent semi-reflective screen 13. As in the previous embodiment, the user views the copied material on 13 directly overlying the copied material 12.

Figure 3:
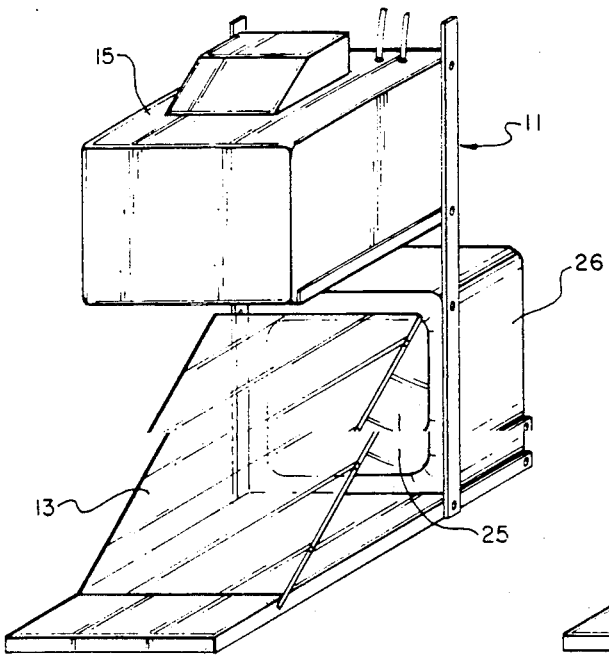
FIG. 3, is a similar view showing yet another embodiment of the invention.

As shown in FIG. 3, the to be copied may also be displayed on a screen 25. The screen 25, here shown as the screen of a cathode ray 26, may alternatively be the screen of an overhead projector other such unit capable of displacing material to be copied. The semi-reflective semi-transparent sheet 13 receives copied material that overlies the material to be copied as shown on the screen 25.

Figure 4:
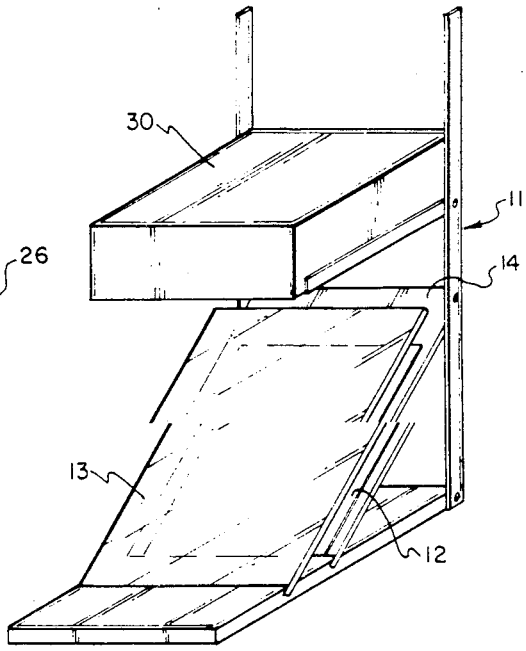
FIG. 4, is a perspective view of another embodiment of the invention.

While the embodiment of FIG. 1 utilizes a cathode ray projector 15 to project copies material to a semi-transparent semi-reflective sheet 13, the copy viewer embodiment of FIG. 4, uses a multiple light source projector 30 in place of the cathode ray projector 14.

The light arrays are used to form images of the copied material and are projected onto the sheet 13.

Figure 5:
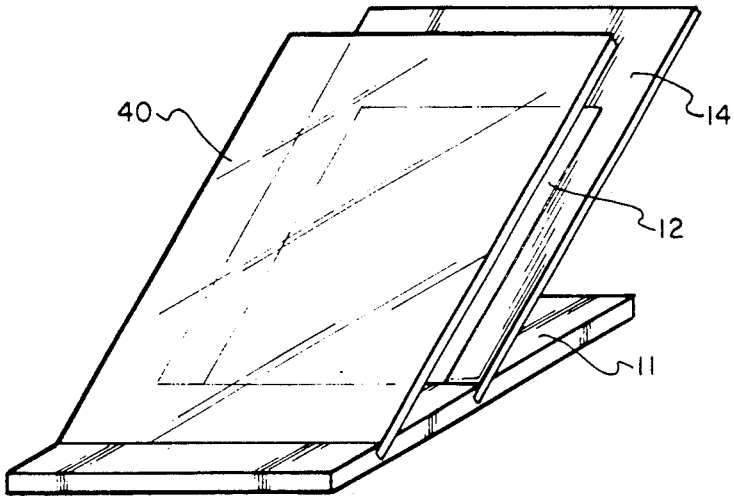
FIG. 5, is a similar perspective view of still another embodiment of the invention that involves a liquid crystal display overlapping a paper.
Figure 6:
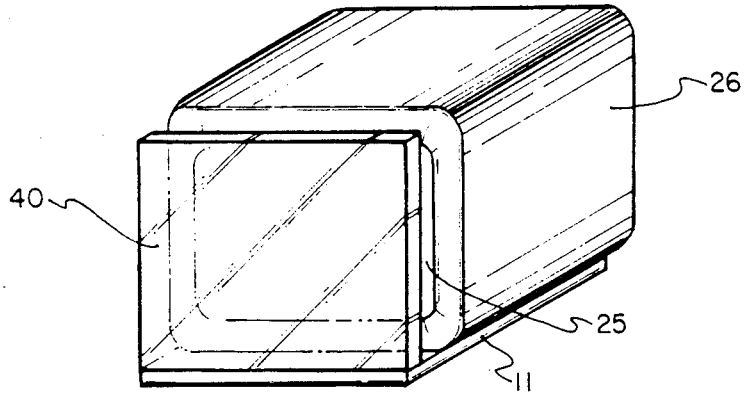
FIG. 6, is a perspective view of an embodiment of the invention wherein a screen of a CRT display unit serves as both a holder for material to be copied and a display for material copied and with one such material overlying the other.

In the embodiments of FIGS. 5 and 6, projectors are not used to project material to a semi-transparent semi-reflective sheet as in the previous embodiments. Rather, transparent liquid crystal displays 40 receive inputs indicative of the material copied and overlie the material 12 being copied. The material 12 being copied may be supported by a holder 14, of the type shown in FIG. 1, or it may be a screen 25 of the type shown in FIG. 3.

Figure 7:
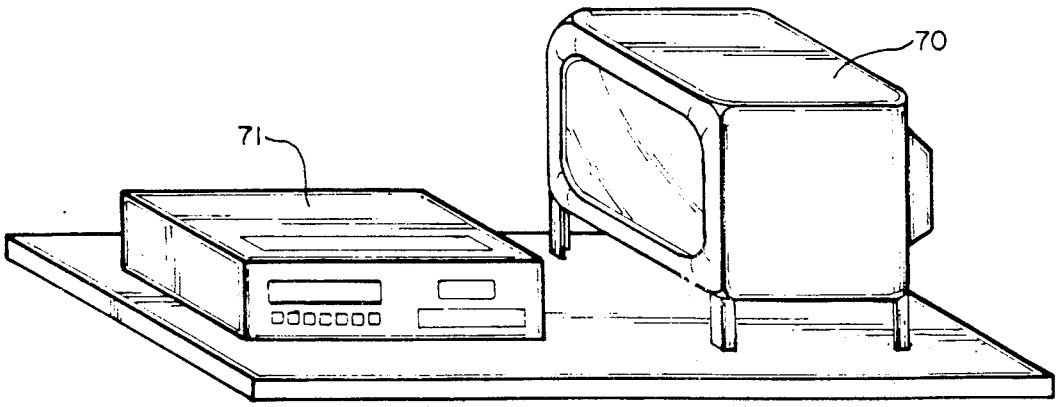
FIG. 7, is a perspective view of another embodiment of the invention that utilizes a video screen display receiving a program from a VCR projecting device.

As shown in FIG. 7, the holder for material to be copied may be either a VCR display device 70 or a VCR projector 71.

If the material to be copied is displayed by the display device 70, the material copied will be directed by the VCR projector to the screen of the display device 70 and the copied material will thus overlie the material to be copied.

If the material to be copied is projected from the projector 71 to the screen of the display device 70, it will overlie the material copied, which is fed into the display device 70.

Whether the material to be copied is supplied to the display device or to the projector, or vice versa, an overlying relationship that will permit easy viewing is established.

It will be apparent that with any of the embodiments of the invention corrections are made to the material copied in conventional ways. Such corrections will generally be made using the input device used in copying material.

Although a preferred form of my invention has been herein disclosed, it is to be understood that the present disclosure is by way of example and that variations are possible without departing from the subject matter coming within the scope of the following claims and a reasonable equivalency, which subject matter I regard as my invention.

I claim:

1. A copy viewer comprising a support stand; means for supporting material to be copied on the support stand; and means for displaying copied material to overlie the material to be copied, whereby a viewer can see the copied material and look through said copied material to the material to be copied for comparison purposes.

2. A copy viewer as in claim 1, wherein the means for supporting material to be copied comprises a backrest to receive sheets of paper and the like thereon containing material to be copied.

3. A copy viewer as in claim 2, wherein the means for displaying copied material comprises a semi-reflective, semi-transparent sheet of material spaced from the backrest and a projector receiving images of material copied and projecting them onto the semi-reflective, semi-transparent sheet to overlie the material being copied.

4. A copy viewer as in claim 1, wherein the means for supporting material to be copied comprises a viewing screen and means to project said material to be copied onto said viewing screen.

5. A copy viewer as in claim 4, wherein the means for displaying copied material comprises a semi-reflective, semi-transparent sheet of material spaced from the backrest and a projector receiving images of material copied and projecting them onto the semi-reflective, semi-transparent sheet to overlie the material being copied.

6. A copy viewer as in claim 3, wherein the projector receiving images of material copied and projecting them comprise a cathode ray projector.

7. A copy viewer as in claim 4, wherein the projector receiving images of material copied and projecting them comprise a cathode ray projector.

8. A copy viewer as in claim 3, wherein the projector receiving images of material copied and projecting them comprises a multiple light source array of projector.

9. A copy viewer as in claim 1, wherein the means for displaying copied material comprises a transparent liquid crystal display spaced from and overlying the means for supporting material to be copied.

10. A copy viewer as in claim 9, wherein the means for supporting material to be copied comprises a backrest to receive sheets of paper and the like thereon containing material to be copied.

11. A copy viewer as in claim 9, wherein the means for displaying copied material comprises a semi-reflective, semi-transparent sheet of material spaced from the backrest and a projector receiving images of material copied and projecting them onto the semi-reflective, semi-transparent sheet to overlie the material being copied.

* * * * *